US005581051A

United States Patent [19]

Hill

[11] Patent Number: 5,581,051

[45] Date of Patent: Dec. 3, 1996

[54] POWER LINE ISOLATOR

[76] Inventor: Edward C. Hill, 381 Hickling Trail, Barrie, Canada, L4M 6A9

[21] Appl. No.: 327,067

[22] Filed: Oct. 21, 1994

[51] Int. Cl.[6] ..... H01H 31/00

[52] U.S. Cl. ..... 174/138 R; 174/146; 174/169; 174/177; 200/48 R

[58] Field of Search ..... 174/138 R, 146, 174/169, 172, 177, 137 R; 200/48 R, 48 KB, 49

[56] References Cited

U.S. PATENT DOCUMENTS

| | | | |
|---|---|---|---|
| 2,838,595 | 6/1958 | Parkyn | 174/138 R |
| 3,621,160 | 11/1971 | Turner | 200/48 R |
| 3,668,341 | 6/1972 | Smedley et al. | 200/48 R |
| 3,958,089 | 5/1976 | Anderson | 200/48 KB |

*Primary Examiner*—Laura Thomas
*Assistant Examiner*—Paramita Ghosh
*Attorney, Agent, or Firm*—Weingarten, Schurgin, Gagnebin & Hayes

[57] ABSTRACT

An insulating assembly for an overhead power line has a main subassembly formed of two parallel spaced insulators joined at their ends by aluminum end pieces. The end pieces each have a slot aligned with the space between the two insulators and a rod projecting from the end piece in alignment with the slot but below the slot. This arrangement enables the subassembly to be hung on a hot power line with the line passing along the slots and the space between the insulators. The rods may be clamped to the line by any suitable device such as wedges and C-shaped clamps. With the subassembly thus mechanically and electrically connected securely to the line, the line can be severed at a location between the end pieces and the free ends forced apart.

5 Claims, 4 Drawing Sheets

POWER LINE ISOLATOR

BACKGROUND OF THE INVENTION

This invention relates to isolating overhead power lines.

The most common way to effect such isolation is to use an assembly which includes two full tension clamps (dead ends) and an insulator in between them. The first full tension clamp is fixed to an overhead line allowing the rest of the assembly to hang freely from the power line. In some cases hooks can support the assembly closer to the power line as to keep the assembly from hanging down and possibly making contact with live lines. A mechanical hoist is then attached to the power line away from the assembly. The other end of the hoist is then attached to the full tension clamp at the free end of the assembly. The hoist is then operated in such a fashion as to take up the assembly parallel to the power line and introduce some slack line in between the clamps at each end of the isolator assembly. The second full tension clamp is now fastened to the power line. The hoist can now be removed. The power line tension is now transferred through the isolator assembly and the short portion of line in between the two clamps bulges due to the lack of tension on that portion. This line portion can now be cut and separated to isolate the line.

The assembly is now mechanically connected between cut ends of rite line. Often the assembly also includes a switch connected in parallel across the insulator and both ends of the switch now have to be connected electrically to respective portions of the cut line. This may be done using C-shaped members and wedges.

This technique is time consuming and difficult for one man to carry out particularly because of the need for a hoist.

Another technique has been proposed in U.S. Pat. No. 4,814,530. This technique involves an isolating apparatus having clamps pivotally mounted at opposite ends of a insulator. The clamps can be secured to the power line such that the insulator lies below and parallel to the line, and thereafter the power line can be severed between the clamps. One reason that this apparatus has not found acceptance in practice is that, after the line is cut, there is an immediate and sudden straightening of the apparatus caused by the tension in the line and gives rise to severe forces in the line and particularly at the clamps.

It is an object of the invention to provide an improved isolating apparatus and method.

SUMMARY OF THE INVENTION

In its broadest form, the instant invention involves the use of an offset insulator which can be clamped at opposite ends to the live power line. The one clamping action provides both a mechanical and electrical connection to the line.

Because the insulator is offset, after the clamping step the line runs parallel to and spaced from the insulator. The line may then be cut between the clamped portions and the severed ends bent away from each other or the section can be cut out. There is no whipping of the line after severing because the offset allows the insulator to be clamped without displacing the line from its natural lie and because there is no pivotal connection between the ends of the insulator and the clamps.

In a preferred embodiment the isolating apparatus is formed of two parallel spaced insulators interconnected by aluminum end pieces which are clamped to the line alter the apparatus is hung on the line with the line passing along the space between the insulators.

DETAILED DESCRIPTION OF THE PREFERRED EMBODIMENTS

Figure 1:
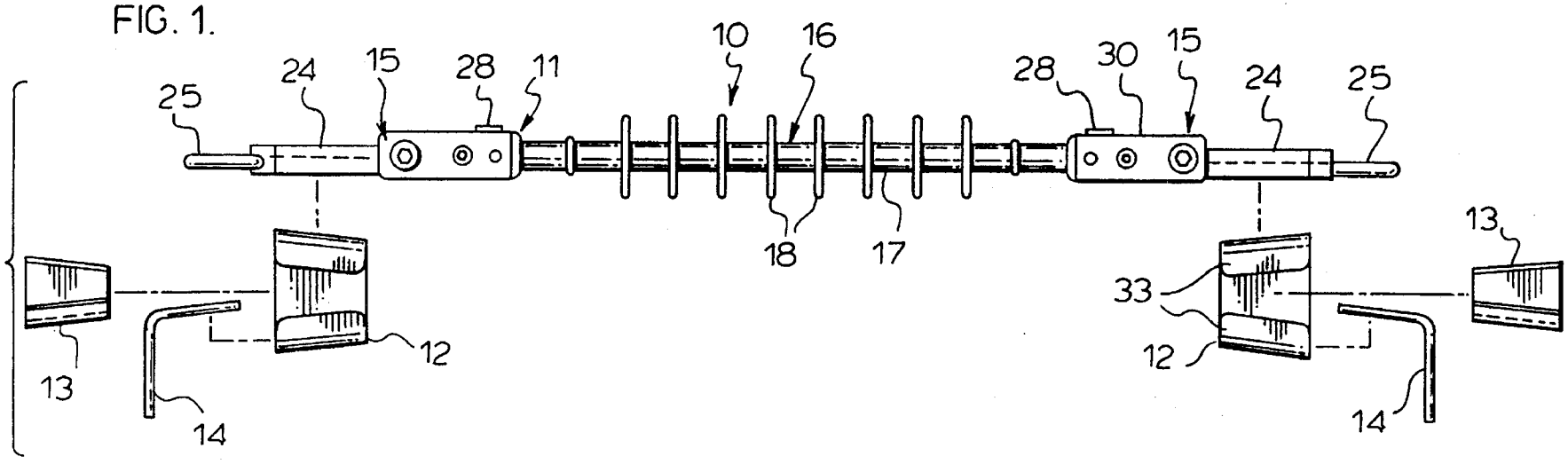
FIG. 1 is a side elevational, partly exploded view of an isolating assembly according to the invention.
Figure 2:
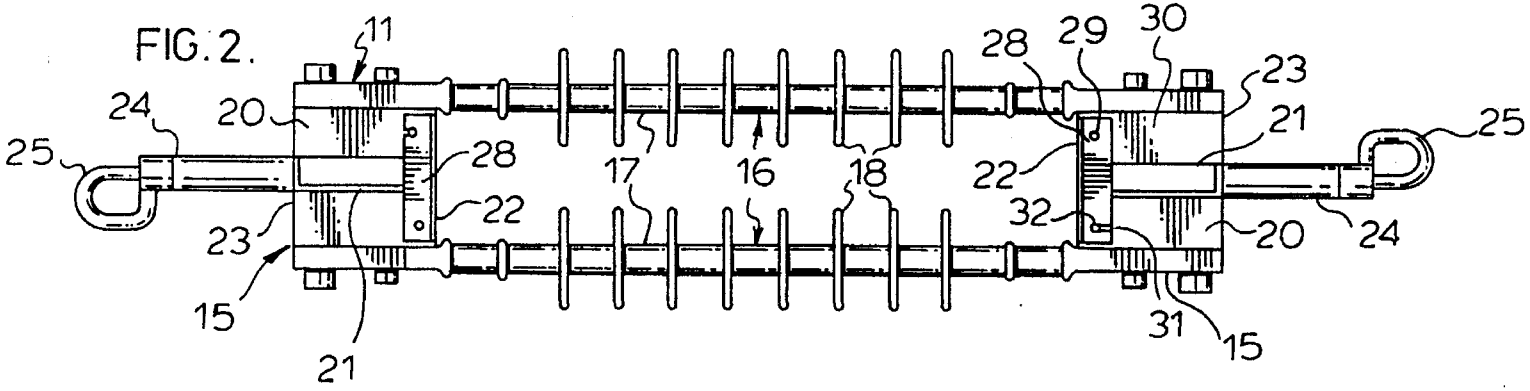
FIG. 2 is a top view of the main component of the isolating assembly of FIG. 1.

Referring firstly to FIGS. 1 and 2, the isolating assembly 10 comprises a main component 11, two C-shaped members 12, two wedges 13 and two jumper studs 14.

The main component 11 is formed by two aluminum end pieces 15 spaced apart by two identical parallel spaced insulators 16 each of which typically is formed of a fiberglass rod 17 having a rubberized exterior and a series of spaced integral discs 18 which are also rubberized. Porcelain can also be used for the insulators 16. The insulators 16 are securely connected to the end pieces 15 by any suitable means such as crimping.

Each end piece 15 has a generally rectangular portion 20 having a through slot 21 extending between an inner end 22 and an outer end 23 of rectangular portion 20. The two slots 21 are mutually aligned with an axis extending parallel to and midway between the rods 17. Each end piece also includes a rod 24 which is secured to the rectangular portion 20 for example by means of a weld and extends from the outer end in alignment with the axis of the slot 21 as seen in FIG. 2 but slightly below the level of the slot 21 as seen in FIG. 1. The rod 24 may have at its free end an eye 25 for engagement by a hot stick or hoist.

Each end piece 15 is completed by a keeper bar 28 which is pivotally mounted on a pin 29 extending from the upper face 230 as seen in FIG. 2 of rectangular portion 20. The keeper bar 28 may be swung across the slot such that a notch 31 provided in the bar at a location remote from pin 29 engages a stud 32 also extending from upper face 30. A nut (not shown) may be used to engage the stud 32 and secure the keeper bar in the position shown in FIG. 2.

The two C-shaped members 12 and wedges 13 are also made of aluminum and are well known per se for interconnecting two conductors. The C-shaped members 12 each have two spaced curved channels 33. The isolating assembly is completed by the two jumper studs 14 which are formed as angled aluminum or tin plated copper rods.

Figure 3:
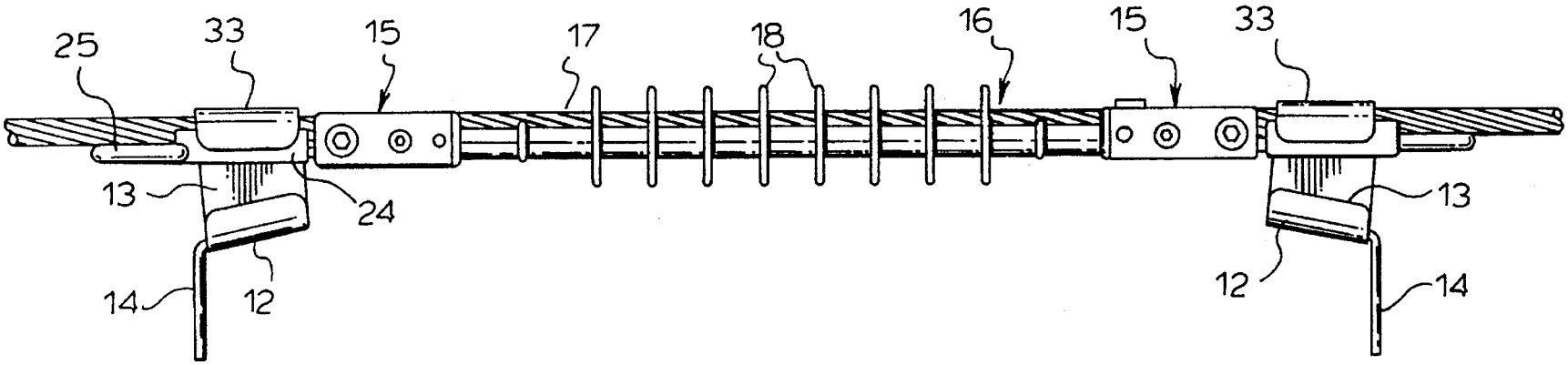
FIG. 3 is a side elevational view of the isolating assembly shown clamped on a power line.
Figure 4:
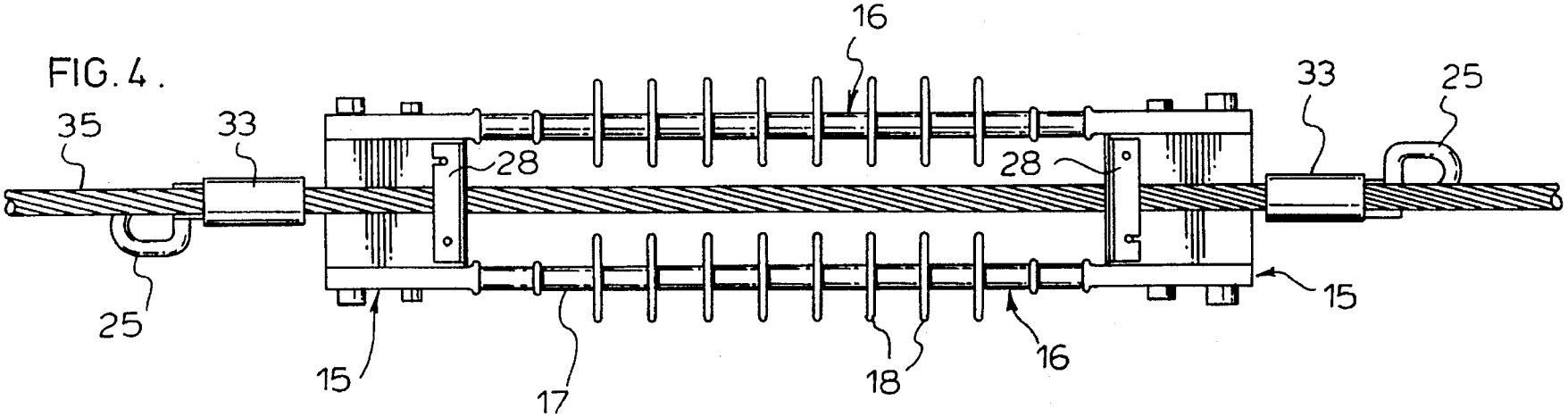
FIG. 4 is a top view of the isolating assembly shown clamped on a power line.
Figure 5:
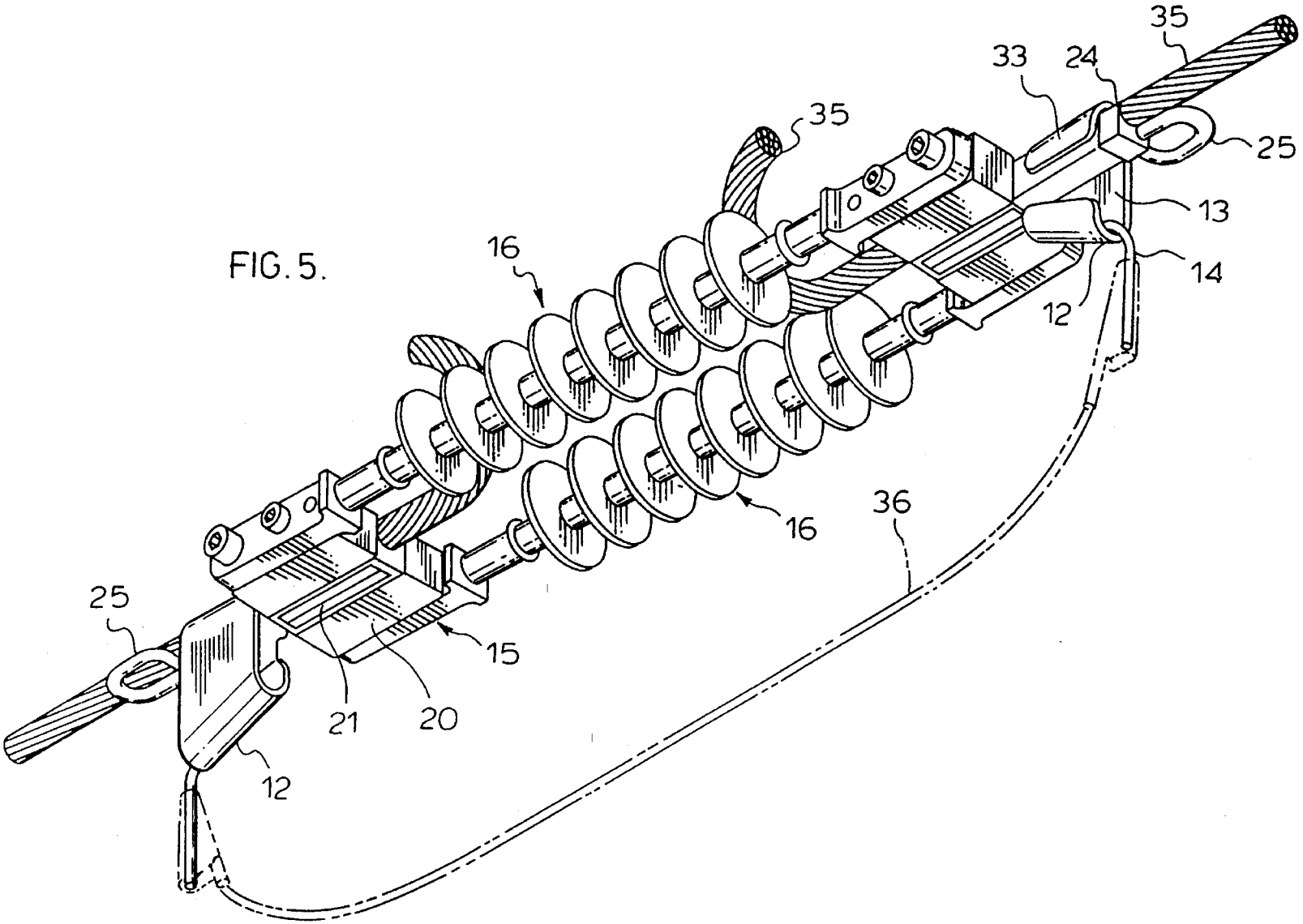
FIG. 5 is an isometric view of the isolating assembly shown clamped to the power line and after the power line has been cut.

Referring now to FIGS. 3 to 5, these show the isolating assembly 10 clamped to a power line 35. To apply the isolating assembly to the power line the main component 11 is hung on the power line by aligning the power line 35 along the slots 21 and swinging the keeper bars 28 across the respective slots 21 and securing them to the studs 32 by means of the nuts (not shown). This step might best be accomplished by firstly laying the main component 11 on top of the line 35, then securing the keeper bars 28 and finally rotating the main component 11 about line 35 such that the keeper bars 28 lie on top of the line 35 as shown in FIGS. 3 and 4. Other installation practices may be used.

With the main component 11 hung on the power line 35 the C-shaped members 12 can then be hung over the power line 35 in registry respectively with the rods 24 of the end pieces 15. Thus, a curved channel 33 of each C-shaped member 12 encompasses one of the rods 24 and a portion of power line 35. The jumper studs 14 are then positioned respectively in the other curved channels of the C-shaped members and the wedges 13 are forced into the C-shaped members by means of a powder actuated tool in a manner know per se to clamp the power line 35 securely to the rods 24 and to clamp the jumper studs 14 to the C-shaped members.

FIG. 5, which is an isometric view looking from underneath the power line, shows that the rod 24 is preferably contoured on its upper surface in a fashion complementary to that of the curved channel 33 so as to define a generally circular section space for reception of power line 30.

Once the isolating assembly 10 and power line 35 have been clamped together the power line can be cut by wire snippers at a point lying between the two insulators 16, preferably substantially equidistantly from the end pieces 15. It is noted that when the power line 35 is cut there is no recoil of the line or movement of the clamps 12, 13. Then, as shown in FIG. 5 the two cut ends are forced upwardly and away from each other to isolate the power line 35 or the section between the ends can be cut out completely. A jumper cable 36, shown in phantom in FIG. 5 may be connected across jumper studs 14 as desired to re-energise the line.

A jumper cable is only one of several techniques for re-establishing electrical connection across the cut ends of the line.

Instead of the insulators 16 being displaced laterally (in the horizontal plane), the isolating assembly 10 could be rotated 90° so that the insulators are both located in the vertical plane or the assembly could be rotated to any intermediate position.

Figure 6:
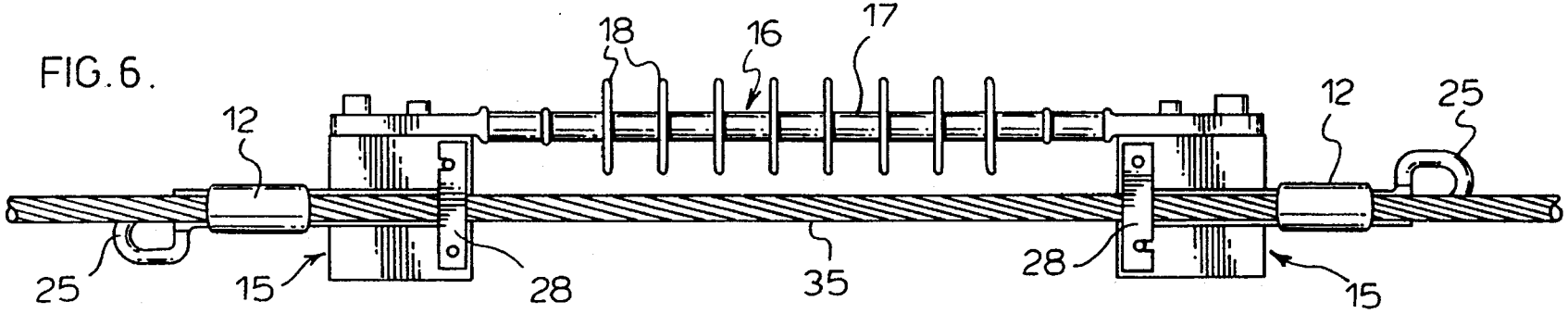
FIG. 6, is a view similar to FIG. 4 but showing a modified form of isolating assembly.

Referring now to FIG. 6, this shows a form of the invention in which one of the insulators 16 has been dispensed with, leaving only a single insulator 16 offset laterally with respect to the axis of the power line 35. Instead of offsetting the single insulator laterally it may be offset instead vertically above or below the power line.

Figure 7:
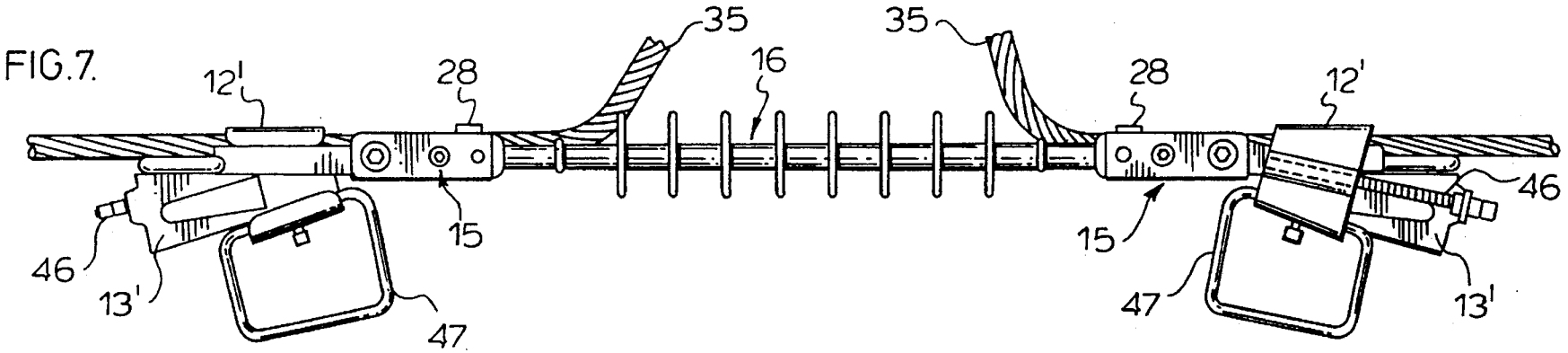
FIG. 7 is a side view of the isolating assembly shown clamped to the power line and after the power line has been cut and incorporating a modified clamping arrangement.

With reference to FIG. 7, this shows that instead of clamping means illustrated in FIGS. 1 to 6 a bolted clamping mechanism could be used. This again involves the use of a C-shaped member 12' and a wedge 13' but these two members are interconnected by a screw 46 which can be turned to force the wedge into the C-shaped member thereby clamping the power line 35 to the rod 24 of the isolating assembly. FIG. 7 also shows the optional use of stirrups 47 instead of angled jumper studs 14.

Figure 8:
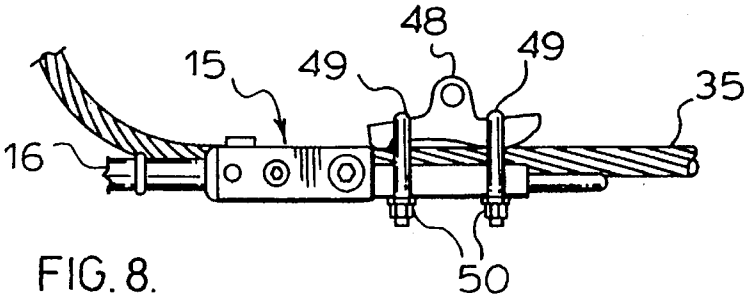
FIG. 8 is a fragmentary view showing a further type of clamping arrangement.

Finally, FIG. 8 shows yet another type of clamping mechanism known per se which involves the use of a member 49 secured opposite the rod 24 by means of U-shaped bolts 40 and nuts 41. Tightening of the nuts 40 clamps power line 35 between member 39 and rod 24.

It is envisaged that with appropriate minor refinements the apparatus could be installed using a hot stick but in its present form it is more appropriately applied directly,

What is claimed:

1. An isolating apparatus for an electric power line comprising two elongate substantially identical insulators; power line securing means for securing opposite ends of the insulators to the power line, comprising a pair of end pieces having the respective ends of said insulators secured thereto in mutually spaced apart relation such that the insulators are coextensive and substantially parallel; said power line securing means each being located between said ends of said insulators, whereby, in use, with the insulators secured to the power line the power line is secured in substantially coplanar parallel relation between the insulators and may be cut at a position intermediate said end pieces.

2. An isolating apparatus according to claim 1 in which the end pieces are electrically conductive and the means for securing opposite ends of the insulators to the power line are electrically conductive clamps arranged to secure the electrically conductive end pieces to the power line.

3. The isolating apparatus according to claim 1, said end pieces each being electrically conductive; said end pieces including jumper line attachment means, in use to receive the ends of a jumper line in secured, electrically conductive relation therewith, to facilitate re-establishment of service by said electric power line.

4. The isolation apparatus according to claim 1, said end pieces including jumper line attachment means in respective electrical connecting relation with said power line securing means, in use to receive the ends of a jumper line in secured, electrically conductive relation with said power line, to facilitate re-establishment of service by said electric power line.

5. A method of electrically isolating a power line comprising: hanging a line isolating apparatus on the power line, the apparatus comprising two elongate substantially identical insulators, two electrically conductive end pieces secured to opposite ends of the insulators and holding the insulators in parallel spaced relationship, such that the power line runs parallel to and between the insulators; clamping the end pieces to the power line; and cutting the power line between the end pieces.

* * * * *